US006752183B2

(12) United States Patent
Leoncavallo

(10) Patent No.: US 6,752,183 B2
(45) Date of Patent: Jun. 22, 2004

(54) WASTE FUNNEL SYSTEM

(75) Inventor: Richard A. Leoncavallo, Niagara Falls, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 82 days.

(21) Appl. No.: 10/017,700

(22) Filed: Dec. 7, 2001

(65) Prior Publication Data

US 2003/0106609 A1 Jun. 12, 2003

(51) Int. Cl.[7] ..... B05B 39/00
(52) U.S. Cl. ..... 141/340; 141/331; 141/334; 141/339
(58) Field of Search ..... 141/331–345

(56) References Cited

U.S. PATENT DOCUMENTS

| | | | | |
|---|---|---|---|---|
| 5,092,471 A | * | 3/1992 | Pinizzotto et al. | 209/614 |
| 5,277,234 A | * | 1/1994 | Warstler | 141/299 |
| 5,515,892 A | | 5/1996 | Najafi et al. | |
| 5,676,185 A | * | 10/1997 | Starr et al. | 141/300 |
| 5,921,296 A | * | 7/1999 | Porter et al. | 141/340 |
| 5,975,156 A | * | 11/1999 | Senour | 141/98 |

OTHER PUBLICATIONS

Nalge Nunc International Corp., *NALGENE® Safety Waste Systems*, Product Brochure, 1997.

Lab Safety Supply Inc., *Safety Waste Funnels*, Labware Direct™ Catalog, p. 42, dated 2000.

Nalge Nunc International Corp., *NALGENE® Safety Waste System*, Catalog Brochure, Jun., 2001.

* cited by examiner

*Primary Examiner*—Gregory L. Huson
*Assistant Examiner*—Peter deVore
(74) *Attorney, Agent, or Firm*—Wood, Herron & Evans, L.L.P.

(57) ABSTRACT

A waste funnel system for pouring liquids into a container. The waste funnel system has an adapter with a closure that can be mounted to an opening of the container. A funnel body has a cover that is pivotally connected to the funnel body and is used to open and close an inlet end of the funnel. The funnel body is also assembled in the adapter, thereby permitting different size funnel bodies to be assembled with the same container closure. A ventilation path extends between the funnel body and the adapter to permit vapors to be displaced from an interior of the container. In addition, a screen disposed in a liquid path between inlet and outlet ends of the funnel body prevents objects from passing through the funnel system.

35 Claims, 3 Drawing Sheets

WASTE FUNNEL SYSTEM

FIELD OF THE INVENTION

This invention relates to liquid handling systems and, more particularly, to an improved waste funnel system for handling chemical and biological liquid waste.

BACKGROUND OF THE INVENTION

Chemical and biological waste is being created in ever increasing quantities in laboratories, manufacturing plants and other facilities. Chemical and biological liquid waste such as non-halogenated hydrocarbons, acids, bases and other liquids requires special handling prior to disposal. Normally such waste is accumulated in a waste container designated for waste disposal; and after the waste container is full, it is removed for proper disposal of the waste therein.

During the time that waste is being accumulated in the waste container, a funnel is normally placed in the opening of the container. Funnels are commercially available that are designed for this purpose. For example, such funnels have threaded closures that mate with a threaded openings on the waste container. In addition, some funnels often have hinged lids to prevent the unnecessary leakage of waste vapors from entering the environment. Other funnels have more elaborate ball valves to prevent the leakage of waste vapors into the environment.

Known funnels are very effective in properly transferring waste liquids into a waste container for interim storage. However, the known funnels have several drawbacks and disadvantages. First, known funnels often result in a large inventory of parts. For example, funnels may be used on a wide range of waste containers that range in size from 1 gallon to 55 gallons. Further, although there is some standardization of closures for waste containers, there are still a number of different opening and thread sizes. In addition, depending on the application, the inlet opening of the funnel may vary in size, for example, from about 3–10 inches. With known funnels, each funnel is integral with each closure; and therefore, if a variety of funnel sizes is required, a large inventory of funnels must be acquired and stored.

Another disadvantage of known funnels is that they are subject to back-splash. As liquid is being poured through the funnel into the waste container, the liquid is displacing air in the container. However, there is no place for the air to leave the container; and periodically, it will push back up through the funnel causing a back-splash of the liquid waste. Such a back-splash of the liquid waste is highly undesirable.

A further disadvantage of commercially available funnels is that they are subject to leakage if the waste container is tipped over. With commercially available funnels, the funnel lid is free to open if the waste container is tipped over; and the liquid waste is able to escape from the waste container and the funnel. Not only is the cleanup process costly, but the liquid waste may contaminate surrounding equipment resulting in additional cleanup costs.

With many commercially available funnels, there is a continuous, open liquid passage from the funnel bowl through the funnel spout and into the waste container. Often when liquid waste is being poured into the funnel, an instrument, for example, a stirrer or a pen, is being held by the user; and the instrument is dropped into the funnel. With commercially available funnels, the instrument is often carried into the waste container by the flow of the liquid waste. Normally, there are no attempts to retrieve the instrument, not only is there a cost in the replacement of the instrument, but such foreign material in the waste container may require special handling during a disposal/recycling process.

Consequently, there is a need for a funnel that is more cost effective to make and use and, in addition, reduces back-splashing during use as well as leakage if the waste container is tipped over.

SUMMARY OF THE INVENTION

The present invention provides a funnel that is simple in construction, less expensive and more user friendly than known funnels. The funnel of the present invention effectively prevents back-splashes as liquid is poured into the waste container and also blocks the passage of solid objects therethrough. In addition, the funnel minimizes leakage of liquid waste in the event that the waste container and its attached funnel are accidently tipped over. The funnel of the present invention permits different size funnels to be easily assembled with different container closures, thereby substantially reducing the cost of acquiring and storing such funnel systems. Thus, the funnel is especially cost effective and useful in environments where a large variety of funnels is used.

According to the principles of the present invention and in accordance with the described embodiments, the invention provides a waste funnel system for pouring liquids into a container. The waste funnel system has an adapter with a closure that can be mounted to an opening of the container. The funnel body is mountable in the adapter, thereby permitting different size funnel bodies to be assembled with the same container closure. Hence, an inventory of funnels and closures can be reduced. In one aspect of this invention, a screen is placed in a liquid path between inlet and outlet ends of the funnel body to prevent objects from passing through the funnel system.

In another embodiment of the invention, a waste funnel system has an adapter with a closure that can be mounted to an opening of the container. A funnel body is connected to the adapter, and a vent path extends between the funnel body and the adapter to permit vapors to be displaced from an interior of the container. Thus, back-splashes are prevented when liquid is poured into the funnel system and the container.

In one aspect of this invention, a hydrophobic filter is placed in the vent path to prevent liquid from leaking through the vent path in the event the container and funnel system are tipped over. To further prevent leaks, a cover is placed over the funnel body, and the cover may include a seal.

In another embodiment of the invention, a method is provided for pouring liquids through a waste funnel system into a container. First, a first funnel body is mounted in an adapter having a closure, and the closure is connected to an opening of the container. Liquid is then poured through the funnel body and into the container. Thereafter, the first funnel body is removed from the adapter, and a second funnel body is mounted in the adapter.

These and other objects and advantages of the present invention will become more readily apparent during the following detailed description taken in conjunction with the drawings herein.

BRIEF DESCRIPTION OF THE DRAWINGS

FIG. 1A is an exploded cross-sectional view illustrating a mechanical coupling between a funnel body and an adapter of the waste funnel system of FIG. 1.

FIG. 1B is an exploded cross-sectional view illustrating a mechanical coupling between a screen and the waste funnel system of FIG. 1.

DETAILED DESCRIPTION OF THE INVENTION

Figure 1:
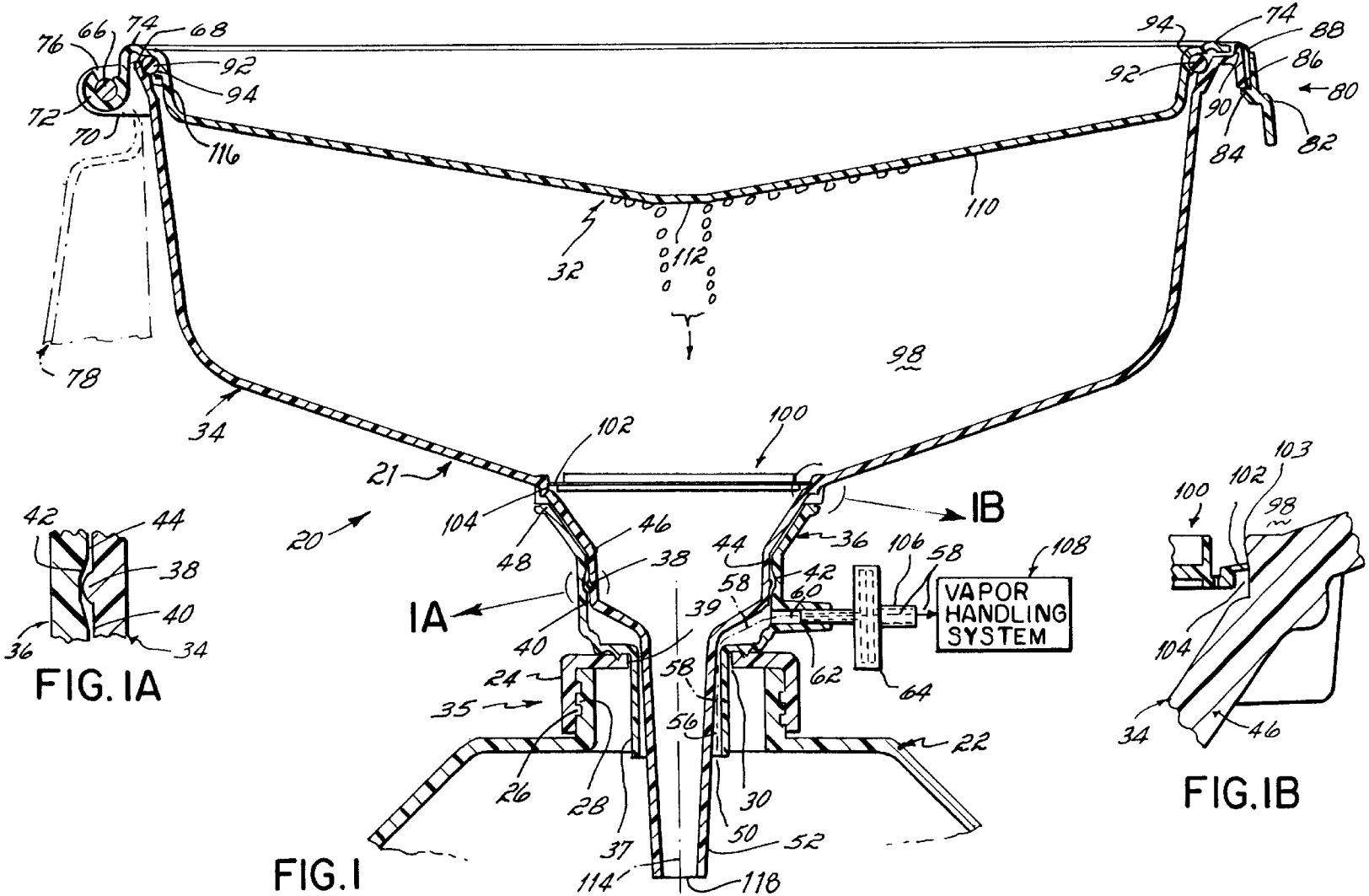
FIG. 1 is a centerline cross-sectional view of a waste funnel system in accordance with the principles of the present invention.
Figure 2:
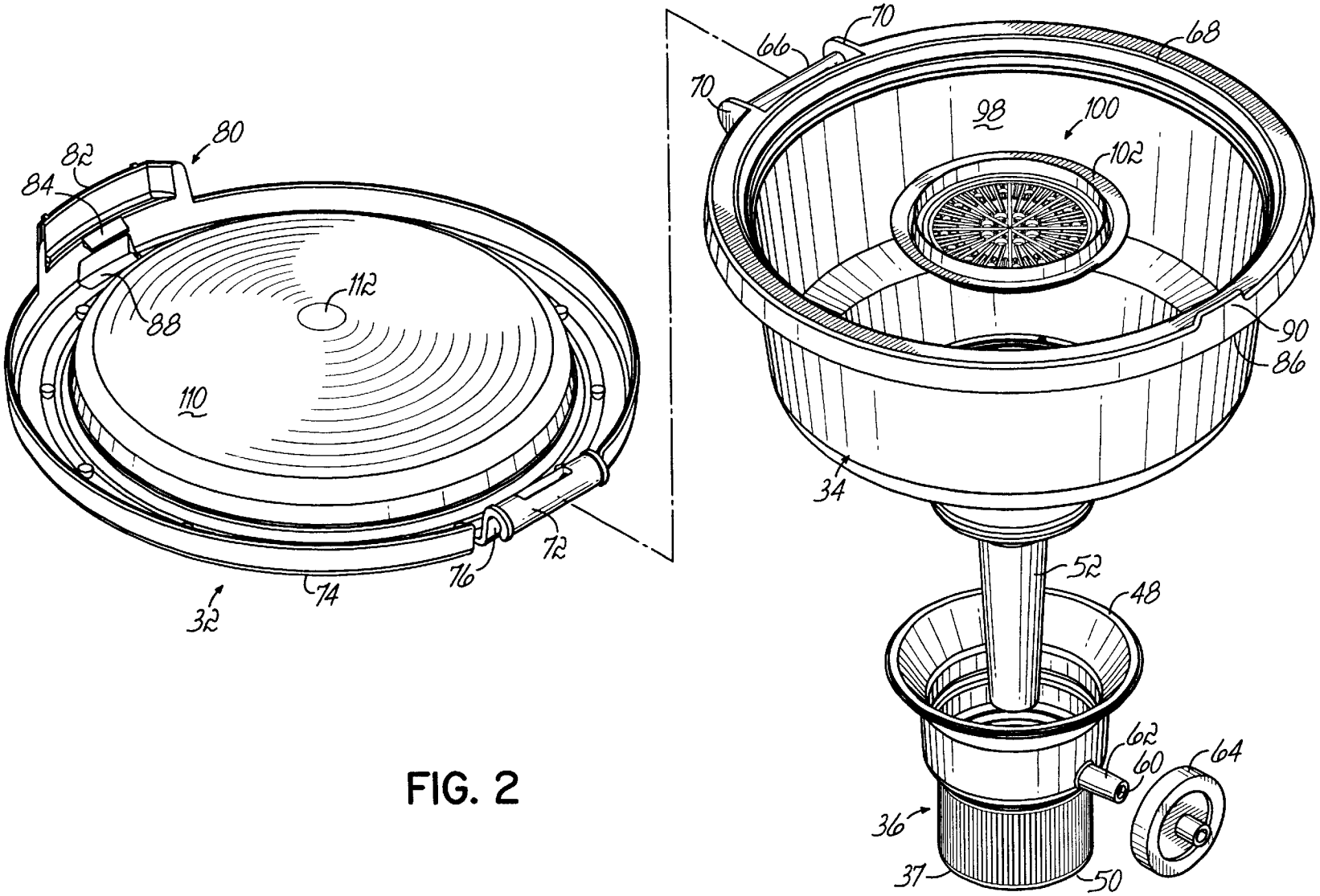
FIG. 2 is disassembled perspective view of the components of the waste funnel system of FIG. 1.

Referring to FIGS. 1–2, a funnel system 20 is removably attachable to a waste container 22. The funnel system 20 has a cover 32 that is pivotally connected to a funnel body 34. The cover 32 permits the funnel system 20 and waste container 22 to be selectively opened and closed. The funnel system 20 includes a funnel 21 comprised of a generally tubular funnel body 34 that is removably mountable in a generally tubular closure assembly 35. The closure assembly 35 is comprised of a cap or closure 24 and an adapter 36. The closure 24 has internal threads 26 that mate with threads 28 adjacent an opening 30 of the waste container 22 upon a user attaching the closure to the waste container 22. The adapter 36 is rigidly attached to the closure 24 by welding, adhesives, a friction fit or other known means, so that the closure and the adapter 36 are a unitary structure. A lower portion 37 of the adapter extends through an opening 39 in the closure 24. The funnel body 34 includes an upper bowl 98, an intermediate midsection 46 and a lower spout 52.

The adapter 36 is generally shaped the same as, but slightly larger than, a midsection 46 of the funnel body 34, so that the funnel body midsection 46 nests inside the adapter 36. The adapter 36 has a circular upper opening 48 that receives the funnel body 34 and a circular lower opening 50 through which the spout 52 of the funnel body 34 extends into the interior of the waste container 22. As shown in FIGS. 1 and 1A, the funnel body 34 has a locating ring 38 on an exterior surface 40 of the midsection 46. The adapter 36 has an annular locating groove 42 on an interior surface 44. The funnel body 34 and adapter 36 are sufficiently resilient so that, as the funnel body 34 is inserted into the adapter 36, the locating ring 38 snaps into and seats in the mating locating groove 42. Thus, the ring 38 and groove 42 function as coupling members to releasably secure the funnel body 34 within the closure assembly 35. Further, with the locating ring 38 and locating groove 42 being the principle area of contact between the funnel body 34 and closure assembly 35, the funnel body 34 is freely rotatable with respect to the adapter 36. By applying a generally longitudinal separating force, the funnel body locating ring 38 can be snapped out of the adapter groove 42, thereby releasing the funnel body 34 from the adapter 36. Thus, different funnel bodies, for example, those having different bowl sizes, can be removably assembled with the same closure assembly 35.

The assembly of the funnel body 34 into the closure assembly 35 provides another important feature of the funnel system 20. The funnel body spout 52 has an external diameter that is slightly smaller than the internal diameter of the lower portion 37 of the adapter 36. Therefore, when the funnel body 34 is removably secured in the adapter 36, an annular space 56 is formed. The annular space 56 is a part of a vapor path or vent path that extends through an opening 60 in a sidewall of the adapter 36. In this embodiment, the opening 60 extends through a tubular connector or stem 62. Air and vapors in the waste container 22 are vented therefrom by passing through the vent path 58 to a location outside the waste container 22. A hydrophobic filter 64 is removably connected to the connector 62, thereby preventing the escape of any liquid waste but not preventing the escape of the air and vapors from the interior to the exterior of the container 22. Such a hydrophobic filter is commercially available as Catalog No. 199-2045 from Pall Corp. of East Hills, N.Y.

Referring to FIGS. 1 and 2, the funnel body 34 has a stationary hinge pin 66 displaced from an upper rim 68 of the funnel body 34 by a pair of standoff brackets 70. In this embodiment, the hinge pin 66 is molded with the funnel body 34 and is integral therewith. The cover 32 has an arcuate hinge strap 72 extending from an outer rim 74. The hinge strap 72 is shaped to fit over the pin 66 and has a cross-section that does not form a closed circle. The hinge strap 72 has an opening 76 that is less than a diameter of the hinge pin 66. The hinge strap 72 is sufficiently resilient to permit the hinge pin 76 to be pressed through the opening 76 and into the hinge strap 72. Thus, the hinge pin 66 and hinge strap 72 form a hinge that permits the hinge strap 72 and cover 32 to pivot with respect to the stationary pin 66 of the funnel body 34. When fully opened, the cover 32 has been pivoted somewhat less than 270° and hangs almost vertically downward from the hinge strap 72. Therefore, when fully open, the cover 32 is disposed below the hinge strap 72 as shown in phantom at 78. The generally vertically downward orientation 78 of the cover 32 when the funnel system is open reduces any tipping force that the cover 32 applies to the funnel system 20 and waste container 22.

Diametrically opposite the hinge 72 is a latch 80. The latch 80 is formed by a release level 82 that extends downward from the cover outer rim 74 and over the funnel body upper rim 68. The release lever 82 has a lip 84 that extends under a lower surface 86 of the funnel body upper rim 68. The release lever 82 is sufficiently resilient that as the cover 32 is closed, the lip 84 slides over the funnel body upper rim 68 and under the lower surface 86, thereby latching the cover 32 to the funnel body 34. The latch 80 is released by pulling radially outward on the release lever 82 until the lip 84 is clear of the lower surface 86. The cover 32 can then be pivoted to its fully opened position.

The cover 32 has a slot 88 in its outer rim 74 and the funnel body 34 has a rib 90 that projects longitudinally away from the upper rim 68. As the cover 32 is closed over the funnel body 34, the rib 90 extends through the slot 88 and provides a user with a visual indication that the cover 32 is fully closed and latched.

Both the funnel body upper rim 68 and the cover outer rim 74 have a cross-sectional profile with a generally common shape, for example, an inverted U-shape. Further, the cross-sectional profile of the cover outer rim 74 is slightly larger than the cross-sectional profile of the funnel body upper rim 88. Therefore, when the cover 34 is latched in its closed position, its outer rim 74 fits over the upper rim 68 of the funnel body 34. Thus, there is a substantial generally U-shaped annular area over which the cover outer rim 74 and the funnel body upper rim 68 are in close proximity and immediately adjacent each other. That annular area inhibits the flow of liquid from the funnel body 34 in the event the funnel system 20 and waste container 22 are tipped over. To provide a further barrier and seal between the cover 32 and funnel body 34, an O-ring 92 can be disposed within a groove 94 on the underside of the cover 32.

The upper bowl 98 of the funnel body 34 functions to collect liquid as it is poured into the funnel system 20. The bowl 98 has a generally cone-shaped lower section that reduces in diameter until it transitions into the midsection 46. A screen 100 is located at the transition between the bowl 98 and the midsection 46 and extends transverse to a centerline 114 across a liquid flow passage through the funnel body 34. Referring to FIG. 1B, the screen 100 has a resilient outer rim 102 that snaps into an annular groove 104 formed by a small annular shoulder 103 located at the top of the funnel body midsection 46.

The funnel body 34, cover 32, screen 100 and adapter 36 are normally molded from a high density polyethylene material. However, as will be appreciated, the parts of the funnel system 34 may be made of polypropylene or any other material that is appropriate for the liquid waste to be used with the funnel system. Further, the screen 100 can be sized to block the passage of larger objects; or, alternatively, the screen 100 can be used to block the passage of smaller objects and materials by using a glass prefilter, a microfilter, or any known filter of any size, for example, filters in a range of about 0.8–5.0 microns. Such screens and filters are made and sold by Nalge Nunc International of Rochester, N.Y. Therefore, the screen 100 can be used to stop or impede the flow of almost any size object or material. Further, in the described embodiment, the screen is located at the transition between the bowl 98 and the midsection 46. As will be appreciated, in other embodiments the screen can be located anywhere in the flow path between the inlet end and the outlet end of the funnel body 34.

Figure 3:
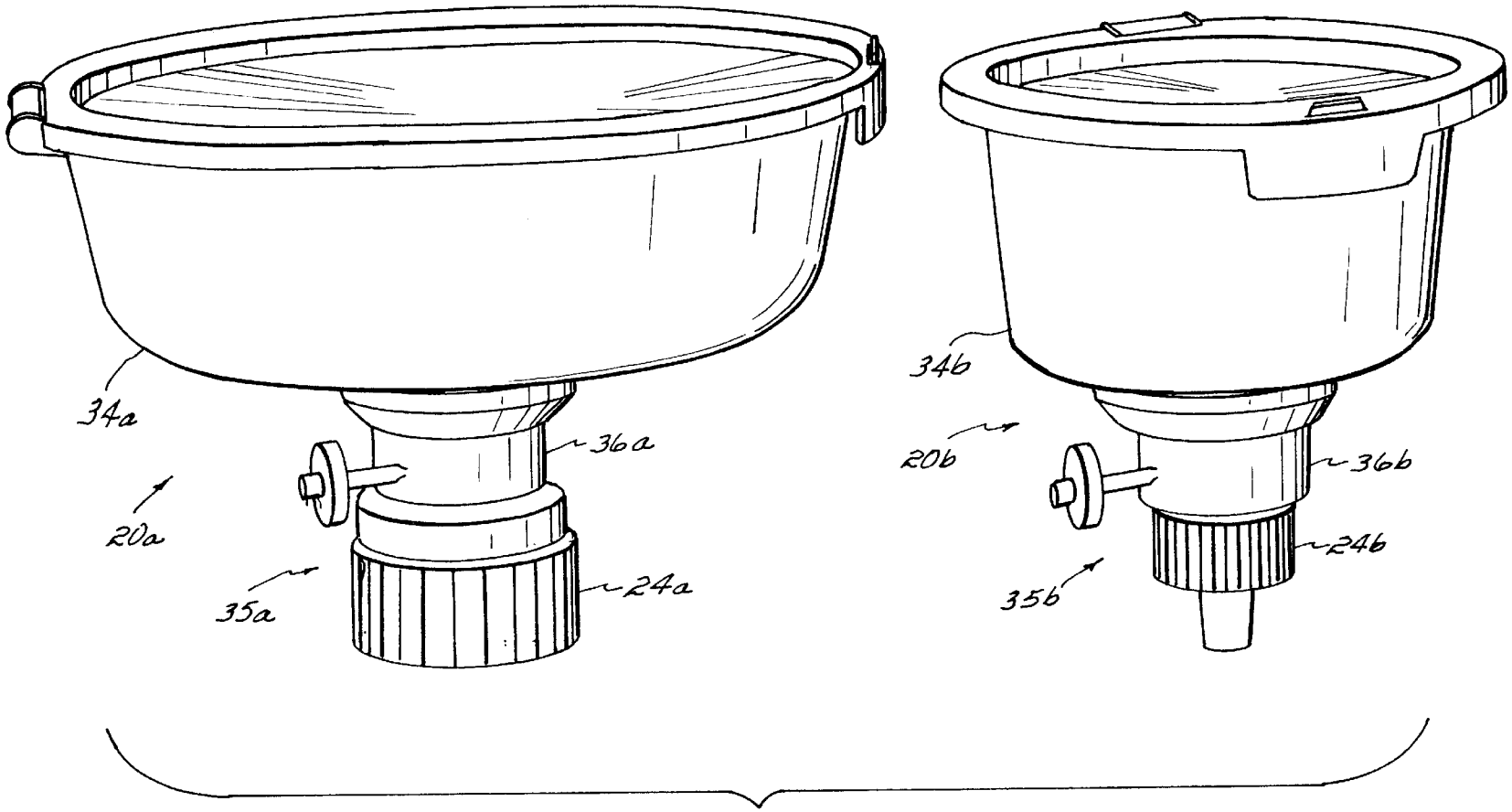
FIG. 3 is a perspective view of two different sizes of the waste funnel systems of FIG. 1.

In use, once a waste container 22 has been identified, a closure assembly 35 having a mating closure 26 is selected. As shown in FIG. 3, the different closure assemblies 35*a*, 35*b* have different size closures 24*a*, 24*b*, respectively; however, the different closure assemblies 35*a*, 35*b* have adapters 36*a*, 36*b*, with identically sized locking grooves 42 (FIG. 1A). Next, a funnel body 34 of the appropriate size is chosen. The funnel bodies may range from about 3–10 inches in diameter, however each of the funnel bodies 34*a*, 34*b* has identically sized locking rings 38 (FIG. 1A). Therefore, each of the adapters 36*a* and 36*b* is connectable with either of the funnel bodies 36*a*, 36*b*. Assume for purposes of this example, that funnel body 34*b* and adapter 36*b* are chosen. The funnel body 34 is then inserted into the closure assembly 35 until the funnel body locking ring 38 (FIGS. 1 and 1A) snaps into the adapter locking groove 42, thereby completing the assembly of a funnel system 20. The funnel system is then mounted on a waste container 22 and the closure 26 is mounted to an opening in the waste container 22. As will be appreciated, the closure assembly 35 can first be mounted on the waste container 22; and thereafter, the funnel body 34 inserted and snapped into the adapter 36 of the closure assembly 35. Thereafter, the latch lever 82 is pulled to release the latch 80; and the cover 32 is pivoted to its generally vertical, open position. The generally vertical orientation 78 of the cover 32 minimizes a tendency of an empty waste container 22 to tip over; and therefore, the open position of the cover 32 does not substantially change the vertical stability of the waste container 22.

Liquid waste is then poured into an inlet end 116 of the funnel body 34. The liquid waste accumulates in the funnel bowl 98, passes through the screen 100, the midsection 46 and the outlet end 118 of the spout 52 that extends into the waste container 22. As the liquid enters the waste container 22, air and vapors in the waste container 22 are displaced and vented from an upper portion of the interior of the container 22, along the vent path 58 and through the filter 64 to a location exterior to the container 22. The vapors may be vented into the surrounding atmosphere or carried to another location. For, example, an output 106 of the filter 64 may be fluidly connected to a vapor handling system 108. The vapor handling system 108 may be a powered or nonpowered ventilation system, filtering system, recycling system, etc. It should be noted that the funnel body 34 is free to rotate about its centerline 114 with respect to the adapter 36. Therefore, the output 106 of the filter 64 can be pivoted to any radial direction to facilitate the exit of vapors from the filter 64 without changing the orientation of the cover 32.

While pouring liquid waste into the funnel bowl 98, it is possible that a stirrer, pen or other object may be dropped into the funnel bowl 98. Any such objects will be stopped by the screen 100 from passing from the funnel bowl 98 into the waste container 22. Further, the screen 100 has drainage grooves that facilitate the drainage of any liquid from an object as it sits on the screen 100. Therefore, the object may be easily retrieved from the screen 100 with a minimum of contamination to the object and a retrieving tool, for example, a user's fingers, tongs, etc. As discussed earlier, the screen 100 can also be used to provide a wide range of filtration from prefiltration to microfiltration.

After the user is finished pouring liquid waste into the container 22, the cover 32 is pivoted back to its closed and latched position. The user can confirm that the cover 32 is properly closed by observing the rib 90 within the cover opening 88. With the cover 32 closed, it is possible for vapors from the waste container 22 to rise through the spout 52, funnel body midsection 46 and into the volume of the funnel bowl 98. Such vapors normally condense on a lower surface 110 of the cover 32. The lower surface 110 slopes downward toward a centerpoint 112 that is approximately coincident with a centerline 114 of a liquid flow passage through the funnel body 34. Therefore, the condensate will drip from the lower centerpoint 112 off of the cover 32, through the spout 52 and back into the waste container 22.

If, during use, the closed waste container 22 is inadvertently tipped over, liquid is able to flow through the spout 52, the midsection 46 and into the funnel bowl 98. With the large annular area between the funnel bowl and cover rims 68, 74, respectively, leakage of liquid from the funnel system 20 is minimal, if any. However, leakage can be further diminished by placing an O-ring 92 in the cover 32. In addition, the hydrophobic filter 64 prevents liquid from escaping from the funnel system 20 through the vent path.

When the waste container 22 is full, the funnel system 20 is often removed, cleaned and stored for reuse. In that process, the funnel body 34 can be removed from the adapter 36 of the closure assembly 35 either for cleaning or storage purposes. Further, as previously described with respect to FIG. 3, if it is desired to use funnel body 34*a* the next time the closure assembly 35*b* is used, funnel body 34*a* can be easily assembled with the closure assembly 34*b*.

The funnel system 20 described herein is simple in construction, less expensive and more user friendly than known funnels. The funnel system 20 permits different sizes of funnel bodies 34 to be easily assembled with the same or different closure assemblies 35, thereby substantially reducing the cost of acquiring and storing such funnel systems. The funnel system 20 has a vent path 58 that effectively prevents back-splashes as liquid is poured into the waste container 22. Further, the screen 100 functions to block the passage of solid objects into the waste container 22. In addition, the rims 68, 74 of the funnel body 34 and cover 32, respectively, are constructed to minimize leakage of liquid waste in the event that the waste container 22 and its attached funnel system 20 are accidently tipped over.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, the funnel body 34 has an ring 38 that snaps into an annular groove 42 on the adapter 36. As will be appreciated, the ring may be located on the adapter 36 and the annular groove located on the funnel body 34.

Further, in the described embodiment, the cover 32 is hinged onto the funnel body 34 via an integral hinge pin. As will be appreciated, a separate hinge pin can be used; and further, the cover 32 can be mounted on the funnel body 34 in other ways. The cover 32 can simply be laid on the funnel body 34 and held on by gravity without using a hinge. Or, the cover 32 may be designed to snap on and off. The pivot hinge can be replaced by a strap that simply secures the cover 32 to the funnel body. Further, while an O-ring is described as providing a better cover seal, other techniques may be used. For example, a seal portion may be molded in the cover or funnel body.

Therefore, the invention in its broadest aspects is not limited to the specific details shown and described. Consequently, departures may be made from the details described herein without departing from the spirit and scope of the claims which follow.

What is claimed is:

1. A waste funnel system for pouring liquids into a container through an opening therein, the waste funnel system comprising:

an adapter comprising an annular wall having an interior surface and an opening extending therethrough, the adapter adapted to be connectable to the opening of the container;

a funnel body having an exterior surface and disposed in the adapter; and a vent path extending between the exterior surface of the funnel body and the interior surface of the annular wall of the adapter, the vent path being contiguous with the opening in the annular wall to permit vapors to be displaced from an interior of the container.

2. The waste funnel system of claim 1 further comprising:

a first coupling member on the adapter; and a second coupling member on the funnel body, the first and second coupling members being engageable to releasably secure the funnel body in the adapter.

3. The waste funnel system of claim 1 further comprising:

a ring located on one of the adapter and the funnel body; and a groove located in another of the adapter and the funnel body, the ring being locatable in the groove to mount the funnel body in the adapter.

4. The waste funnel system of claim 3 wherein the ring is located on an outer surface of the funnel body and the annular groove is located on an inner surface of the adapter.

5. The waste funnel system of claim 1 wherein the adapter comprises a closure adapted to be releasably connectable to the opening of the container.

6. The waste funnel system of claim 1 wherein the funnel body further comprises an inlet end and a cover movable with respect to the funnel body to open and close the inlet end of the funnel body.

7. The waste funnel system of claim 1 further comprising a vapor handling system connected with the vent path.

8. The waste funnel system of claim 1 wherein the funnel body further comprises:

an outlet end and a liquid flow path extending between the inlet and the outlet ends of the funnel body; and a screen disposed in the liquid flow path between the inlet and outlet ends to prevent objects from passing through the funnel system into the container.

9. The waste funnel system of claim 8 wherein the screen is removably mountable in the funnel body.

10. The waste funnel system of claim 1 wherein the funnel body is removably mountable in the adapter.

11. The waste funnel system of claim 1 further comprising an annular passage bounded by the interior surface of the adapter and the exterior surface of the funnel body and extending between the opening in the wall of the adapter and an interior of the container.

12. The waste funnel system of claim 11 wherein the adapter further comprises a tubular stem connected to an outer surface of the adapter over the opening, the tubular stem having an internal passage being contiguous with the opening and a location exterior to the container.

13. The waste funnel system of claim 12 further comprising a hydrophobic filter connected to the tubular stem, the hydrophobic filter blocking a passage of liquid and permitting a flow of vapor therethrough.

14. A waste funnel system for pouring liquids into an interior of a container through an opening therein, the waste funnel system comprising:

an adapter having an annular wall with an interior surface and an opening therethrough, the adapter adapted to be connectable to the opening of the container;

a plurality of funnel bodies, each of the plurality of funnel bodies having an exterior surface and being removably mountable in the adapter; and a vent path extending between the exterior surface of a respective funnel body and the interior surface of the adapter, the vent path being contiguous with the opening in the annular wall of the respective adapter to permit vapors to be displaced from the interior of the container.

15. The waste funnel system of claim 14 wherein the adapter is configured to connect to a container opening of a predetermined configuration, and wherein each of the funnel bodies comprises a bowl section different from others of the funnel bodies.

16. The waste funnel system of claim 15 wherein each of the plurality of funnel bodies further comprises an inlet end;

an outlet end; and a cover movable with respect to the funnel body to open and close the inlet end.

17. A waste funnel system for pouring liquids into an interior of a container through an opening therein, the waste funnel system comprising:

a plurality of adapters, each of the plurality of adapters having an annular wall with an interior surface and an opening extending therethrough, and each of the plurality of adapters having a closure adapted to be connectable to the opening of the container;

a funnel body having an exterior surface and being removably mountable in each of the plurality of adapters; and a vent oath extending between the exterior surface of the funnel body and the interior surface of a respective adapter, the vent oath being contiguous with the opening in the annular wall of the respective adapter to permit vapors to be displaced from the interior of the container.

18. The waste funnel system of claim 17 wherein each of the plurality of adapters comprises a different closure adapted to connect to a different container opening.

19. The waste funnel system of claim 17 further comprising a plurality of funnel bodies, each of the plurality of funnel bodies comprises a bowl section different from others of the funnel bodies and each of the plurality of funnel bodies being mountable in each of the plurality of adapters.

20. The waste funnel system of claim 19 wherein each of the plurality of funnel bodies comprises a section that removably mounts to each of the different adapters.

21. A waste funnel system for pouring liquids into a container through an opening therein, the waste funnel system comprising:

a funnel having an inlet end and adapted to be connectable to the opening of the container, the funnel having a vent path adapted to permit vapors to be displaced from an interior of the container; and a hydrophobic filter disposed in the vent path to block a flow of liquid but permit a vapor flow therethrough.

22. The waste funnel system of claim 21 further comprising:

a cover movable with respect to the funnel to open and close the inlet end of the funnel body; and a seal disposed in the cover and being engageable with the inlet end of the funnel, the seal providing a substantially liquid tight seal at the inlet end of the funnel upon the cover being closed.

23. A waste funnel system for pouring liquids into a container through an opening therein, the waste funnel system comprising:

an adapter adapted to be connectable to the opening of the container;

a funnel body removably mountable in the adapter, the funnel body having an inlet end;

a cover;

a pin supported by one of the cover and the funnel body; and a hinge strap supported by another of the cover and the funnel body, the hinge strap being pivotally connectable over the pin, thereby pivotally connecting the cover to the funnel body and permitting the cover to open and close the inlet end of the funnel body, the hinge strap permitting the cover to be opened to an almost vertical orientation with the cover hanging below the hinge strap.

24. The waste funnel system of claim 23 wherein the cover is pivotable almost 270° from a closed position to an open position to improve the stability of the container having the waste funnel system mounted thereon.

25. The waste funnel system of claim 23 further comprising a seal disposed in the cover and engaging the inlet end of the funnel body for providing a substantially liquid tight seal at the inlet end of the funnel body upon the cover being closed.

26. The waste funnel system of claim 23 wherein the pin is supported by the funnel body and the hinge strap is supported by the cover.

27. A waste funnel system for pouring liquids through an opening of a container comprising:

an adapter having an annular wall with an interior surface and an opening therethrough, the adapter adapted to be connectable to the opening of the container;

a funnel body having an exterior surface and being removably mounted to the adapter, the funnel body having an inlet end and an outlet end with a liquid path extending therebetween, a vent path extending between the interior surface of the adapter and the exterior surface of the funnel body and being contiguous with the opening in the annular wall to permit vapors to be displaced from an interior of the container; and a cover pivotally connectable to the funnel body and movable to open and close the inlet end of the funnel body.

28. The waste funnel system of claim 27 further comprising an O-ring seal disposed in the cover and being engageable with the inlet end of the funnel body for providing a substantially liquid tight seal at the inlet end of the funnel body upon the cover being closed.

29. The waste funnel system of claim 27 further comprising:

an opening in the adapter contiguous with the vent path; and a hydrophobic filter disposed in the vent path to block a flow of liquid but permit a flow of vapor therethrough.

30. The waste funnel system of claim 27 further comprising a screen disposed in the liquid path between the inlet and outlet ends to prevent objects from passing through the funnel body.

31. The waste funnel system of claim 30 wherein the funnel body comprises a larger cross-section portion and a smaller cross-section portion, and the screen is disposed near a transition between the larger cross-section and the smaller cross-section.

32. A method of pouring liquids through a waste funnel system into a container comprising:

mounting a first funnel body having an exterior surface in an adapter having a closure and an annular wall with an interior surface to form a first vent path between the exterior surface of the first funnel body and the interior surface, the first vent path being contiguous with an opening in the annular wall;

connecting the closure to an opening of the container to permit the vent path to connect to an interior of the container;

pouring a liquid through the first funnel body while mounted in the adapter;

removing the first funnel body from the adapter;

mounting a second funnel body having an exterior surface in the adapter to form a second vent path between the exterior surface of the second funnel body and the interior surface of the adapter, the second vent oath being contiguous with the opening in the annular wall; and pouring a liquid through the second funnel body while mounted in the adapter.

33. The method of claim 32 further comprising displacing vapors in the container along a one of the first and second vent paths and the opening in the annular wall during a respective one of the pouring steps.

34. A method of pouring liquids through a waste funnel system into a container comprising:

connecting a closure of an adapter to an opening of the container;

mounting a first funnel body in the adapter to form a first vent path extending between an interior surface of an annular wall of the adapter and an exterior surface of the first funnel body, the first vent path being contiguous with an opening in the annular wall to permit vapors to be displaced from the container;

pouring a liquid through the first funnel body while mounted in the adapter;

removing the first funnel body from the adapter;

mounting a second funnel body in the adapter to form a second vent oath extending between the interior surface of the adapter and an exterior surface of the second funnel body, the second vent path being contiguous with an opening in the annular wall to permit vapors to be displaced from the container; and pouring a liquid through the second funnel body while mounted in the adapter.

35. The method of claim 34 further comprising displacing vapors in the container along a one of the first and second vent paths and the opening in the annular wall during a respective one of the pouring steps.

* * * * *

UNITED STATES PATENT AND TRADEMARK OFFICE

CERTIFICATE OF CORRECTION

PATENT NO. : 6,752,183 B2
DATED : June 22, 2004
INVENTOR(S) : Richard A. Leoncavallo It is certified that error appears in the above-identified patent and that said Letters Patent is hereby corrected as shown below:

Title page,
Item [56], References Cited, OTHER PUBLICATIONS, reads, "Nagle Nunc International Corp., *NALGENE® Safety Waste System*, Catalog Brochure, Jun., 2001." and should read -- Nagle Nunc International Corp., *NALGENE® Safety Waste Systems*, Catalog Brochure, Jun., 2001. --.

Column 8,
Lines 65-67, reads "...a vent oath extending between the exterior surface of the funnel body and the interior surface of a respective adapter, the oath being contiguous with the…" and should read -- ...a vent path extending between the exterior surface of the funnel body and the interior surface of a respective adapter, the path being contiguous with the… --.

Column 10,
Line 52, reads "…interior surface of the adapter, the second vent oath…" and should read -- ...interior surface of the adapter, the second vent path… --.
Line 58, reads "..vapors in the container along a one of the first and second…" and should read -- ...vapors in the container along one of the first and second… --.

Column 11,
Line 8, reads "...second vent oath extending between the interior surface…" and should read -- ...second vent path extending between the interior surface… --.

Column 12,
Line 6, reads "...vapors in the container along a one of the first and second…" and should read -- ...vapors in the container along one of the first and second… --.

Signed and Sealed this

Third Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,752,183 B2
DATED : June 22, 2004
INVENTOR(S) : Richard A. Leoncavallo It is certified that error appears in the above-identified patent and that said Letters Patent is hereby corrected as shown below:

Title page,
Item [56], References Cited, OTHER PUBLICATIONS, reads, "Nagle Nunc International Corp., *NALGENE® Safety Waste System*, Catalog Brochure, Jun., 2001." and should read -- Nalge Nunc International Corp., *NALGENE® Safety Waste Systems*, Catalog Brochure, Jun., 2001. --.

Column 8,
Lines 65-67, reads "...a vent oath extending between the exterior surface of the funnel body and the interior surface of a respective adapter, the oath being contiguous with the…" and should read -- ...a vent path extending between the exterior surface of the funnel body and the interior surface of a respective adapter, the path being contiguous with the… --.

Column 10,
Line 52, reads "…interior surface of the adapter, the second vent oath…" and should read -- ...interior surface of the adapter, the second vent path… --.
Line 58, reads "..vapors in the container along a one of the first and second…" and should read -- ...vapors in the container along one of the first and second… --.

Column 11,
Line 8, reads "...second vent oath extending between the interior surface…" and should read -- ...second vent path extending between the interior surface… --.

UNITED STATES PATENT AND TRADEMARK OFFICE

CERTIFICATE OF CORRECTION

PATENT NO. : 6,752,183 B2
DATED : June 22, 2004
INVENTOR(S) : Richard A. Leoncavallo It is certified that error appears in the above-identified patent and that said Letters Patent is hereby corrected as shown below:

Column 12,
Line 6, reads "...vapors in the container along a one of the first and second…" and should read -- ...vapors in the container along one of the first and second… --.

This certificate supersedes Certificate of Correction issued May 3, 2005.

Signed and Sealed this

Twenty-sixth Day of July, 2005

JON W. DUDAS
*Director of the United States Patent and Trademark Office*